US010621933B2

(12) United States Patent
Zhang et al.

(10) Patent No.: US 10,621,933 B2
(45) Date of Patent: Apr. 14, 2020

(54) DRIVING METHOD AND DRIVING APPARATUS FOR DISPLAY DEVICE, AND DISPLAY DEVICE

(71) Applicants: HEFEI XINSHENG OPTOELECTRONICS TECHNOLOGY CO., LTD., Hefei, Anhui (CN); BOE TECHNOLOGY GROUP CO., LTD., Beijing (CN)

(72) Inventors: Zhiwei Zhang, Beijing (CN); Tao Ma, Beijing (CN); Cheng Chen, Beijing (CN)

(73) Assignees: HEFEI XINSHENG OPTOELECTRONICS TECHNOLOGY CO., LTD., Hefei (CN); BOE TECHNOLOGY GROUP CO., LTD., Beijing (CN)

( * ) Notice: Subject to any disclaimer, the term of this patent is extended or adjusted under 35 U.S.C. 154(b) by 0 days.

(21) Appl. No.: 16/503,724

(22) Filed: Jul. 5, 2019

(65) Prior Publication Data

US 2019/0355320 A1 Nov. 21, 2019

Related U.S. Application Data

(63) Continuation-in-part of application No. 15/232,042, filed on Aug. 9, 2016.

(30) Foreign Application Priority Data

Nov. 6, 2015 (CN) ..... 2015 1 0753611

(51) Int. Cl.
*G09G 3/36* (2006.01)

(52) U.S. Cl.
CPC ..... *G09G 3/3614* (2013.01); *G09G 3/3677* (2013.01); *G09G 3/3696* (2013.01); *G09G 2300/0819* (2013.01); *G09G 2310/0202* (2013.01); *G09G 2320/0233* (2013.01)

(58) Field of Classification Search
CPC .. G09G 3/3614; G09G 3/3696; G09G 3/3677; G09G 2310/0202; G09G 2320/0233; G09G 2300/0819
See application file for complete search history.

(56) References Cited

U.S. PATENT DOCUMENTS

| | | | |
|---|---|---|---|
| 6,753,835 | B1 | 6/2004 | Sakai |
| 6,980,190 | B2 | 12/2005 | Ueda |
| 2004/0179014 | A1 | 9/2004 | Nakano et al. |
| 2008/0259018 | A1 | 10/2008 | Kasai |
| 2010/0118012 | A1 | 5/2010 | Irie et al. |

*Primary Examiner* — Aneeta Yodichkas
(74) *Attorney, Agent, or Firm* — Collard & Roe, P.C.

(57) ABSTRACT

Provided are a driving method and a driving apparatus for a display device, and a display device. The driving method includes inputting a gate driving signal to each gate line progressively, and inputting a gate driving signal to one gate line within each scanning period; inputting a data signal to each data line within each scanning period, and inverting, for one time, polarity of a data signal inputted to the same data line every n scanning periods; and inputting a threshold voltage with a preset time length to a threshold voltage line within each scanning period, latching the data signal inputted to the data line when a threshold voltage is inputted to the threshold voltage line, and outputting the data signal otherwise; wherein the second time length is greater than the first time length.

20 Claims, 4 Drawing Sheets

DRIVING METHOD AND DRIVING APPARATUS FOR DISPLAY DEVICE, AND DISPLAY DEVICE

This application is a Continuation-In-Part of U.S. patent application Ser. No. 15/232,042 filed on Aug. 9, 2016, which claims priority to Chinese Patent Application No. 201510753611.8 filed on Nov. 6, 2015. The present application claims priority to and the benefit of the above-identified applications and the above-identified applications are incorporated by reference herein in their entirety.

TECHNICAL FIELD

The present disclosure relates to a driving method and a driving apparatus for a display device, and a display device.

BACKGROUND

Currently, Thin Film Transistor Liquid Crystal Display (TFT-LCD) has become the mainstream display. Application of Gate-driver On Array (GOA) in TFT-LCD enables TFT-LCD to have a qualitative leap.

With constant advances in display technology, people raise higher requirements for display devices. In order to meet market demands, further increase an aperture ratio of display devices, and reduce production cost of display devices, known solutions have proposed a Dual Gate design of a liquid crystal display panel. However, when the known GOA technique is applied to the Dual Gate design of the liquid crystal display panel, progressive scanning process performed by a GOA circuit on pixel cells will result in that pixel cells in a certain column in the liquid crystal display panel are charged more fully, whereas pixel cells in another column therein are charged insufficiently, which further leads to undesirable phenomena such as vertical stripes (V-line).

SUMMARY

At least one embodiment of the present disclosure provides a driving method and a driving apparatus for a display device, and a display device, which are capable of avoiding or making improvement with respect to undesirable phenomena such as vertical stripes.

According to a first aspect of the present disclosure, there is provided a driving method for a display device, comprising:

inputting a gate driving signal to each gate line progressively, and inputting a gate driving signal to one gate line within each scanning period;

inputting a data signal to each data line within each scanning period, and inverting, for one time, polarity of a data signal inputted to the same data line every n scanning periods, n being a positive integer; and inputting a threshold voltage with a preset time length to a threshold voltage line within each scanning period, inputting a threshold voltage with a first time length to the threshold voltage line if polarity of the data signal within one scanning period is inverted, inputting a threshold voltage with a second time length to the threshold voltage line if polarity of the data signal within one scanning period is not inverted, latching the data signal inputted to the data line when a threshold voltage is inputted to the threshold voltage line, and outputting the data signal inputted to the data line when no threshold voltage is inputted to the threshold voltage line;

wherein the second time length is greater than the first time length.

Optionally, a difference between the first time length and the second time length is a rising delay time length when polarity of the data signal is inverted.

Optionally, n is equal to 2

According to a second aspect of the present disclosure, there is provided an driving apparatus for a display device, said apparatus comprising a gate driving circuit, a source driving circuit and a threshold voltage driving circuit;

the gate driving circuit being connected to each gate line, and configured to input a gate driving signal to each gate line progressively, and input a gate driving signal to one gate line within each scanning period;

the source driving circuit being connected to each data line, and configured to input a data signal to each data line within each scanning period, and invert, for one time, polarity of a data signal inputted to the same data line every n scanning periods; and the threshold voltage driving circuit being connected to a threshold voltage line, and configured to input a threshold voltage with a preset time length to the threshold voltage line within each scanning period, input a threshold voltage with a first time length to the threshold voltage line if polarity of the data signal within one scanning period is inverted, input a threshold voltage with a second time length to the threshold voltage line if polarity of the data signal within one scanning period is not inverted, the data signal inputted to the data line by the source driving circuit being latched when a threshold voltage is inputted to the threshold voltage line by the threshold voltage driving circuit, and the data signal inputted to the data line by the source driving circuit being outputted when no threshold voltage is inputted to the threshold voltage line by the threshold voltage driving circuit;

wherein the second time length is greater than the first time length, and n is a positive integer.

Optionally, the threshold voltage driving circuit is connected to a first input terminal, a second input terminal, a first voltage level terminal, a second voltage level terminal and an output terminal, and configured to output a voltage of the first voltage level terminal to the output terminal when one of a voltage of the first input terminal and a voltage of the second input terminal is a at low voltage level, and the other of the two is at a high voltage level; and output a voltage of the second voltage level terminal to the output terminal when the voltage of the first input terminal and the voltage of the second input terminal both are at high voltage levels or both are at low voltage levels.

Optionally, the threshold voltage driving circuit comprises: a first transistor, a second transistor, a third transistor, a fourth transistor, a fifth transistor, a sixth transistor, a seventh transistor, an eighth transistor, a ninth transistor and a tenth transistor.

A first terminal of the first transistor is connected to the first voltage level terminal, a second terminal thereof is connected to a first terminal of the second transistor, and a gate thereof is connected to the second input terminal.

A second terminal of the second transistor is connected to a first terminal of the third transistor, and a gate thereof is connected to the first input terminal.

A first terminal of the third transistor is connected to a first terminal of the fourth transistor, a second terminal thereof is connected to the second voltage level terminal, and a gate thereof is connected to the second input terminal.

The first terminal of the fourth transistor is connected to a gate of the ninth transistor, a second terminal thereof is connected to the second voltage level terminal, and a gate thereof is connected to the first input terminal.

A first terminal of the fifth transistor is connected to the first voltage level terminal, a second terminal thereof is connected to a second terminal of the eighth transistor, a gate thereof is connected to the second input terminal.

A first terminal of the sixth transistor is connected to the output terminal, a second terminal thereof is connected to a first terminal of the seventh transistor, and a gate thereof is connected to the first input terminal.

A second terminal of the seventh transistor is connected to the second voltage level terminal, and a gate thereof is connected to the second input terminal.

A first terminal of the eighth transistor is connected to the first voltage level terminal, the second terminal thereof is connected to a first terminal of the ninth transistor, and a gate thereof is connected to the first input terminal.

A second terminal of the ninth transistor is connected to the output terminal, and the gate thereof is connected to a gate of the tenth transistor.

A first terminal of the tenth transistor is connected to the output terminal, and a second terminal thereof is connected to the second voltage level terminal.

The first transistor, the second transistor, the fifth transistor, the eighth transistor and the ninth transistor are P-type transistors, and the third transistor, the fourth transistor, the sixth transistor, the seventh transistor and the tenth transistor are N-type transistors.

Optionally, n is equal to 2.

Optionally, a rising edge of a voltage pulse inputted by the second input terminal is aligned with a rising edge of a voltage pulse inputted by the first input terminal, and a frequency of the voltage pulse inputted by the first input terminal is twice that of the voltage pulse inputted by the second input terminal.

Optionally, a length of a voltage pulse inputted by the second input terminal is a rising delay time length when polarity of the data signal is inverted.

According to a third aspect of the present disclosure, there is provided a display device, comprising the driving apparatus described above.

In the driving method for a display device as provided by at least one embodiment of the present disclosure, within each scanning period, a gate driving signal is inputted to one gate line, a data signal is inputted to each data line, and a threshold voltage with a preset time length is inputted to a threshold voltage line, as the data signal inputted to the data line is latched when a threshold voltage is inputted to the threshold voltage line, and the data signal inputted to the data line is outputted when no threshold voltage is inputted to the threshold voltage line, a threshold voltage with a first time length is inputted to the threshold voltage line if polarity of the data signal within one scanning period is inverted, a threshold voltage with a second time length is inputted to the threshold voltage line if polarity of the data signal within one scanning period is not inverted, the second time length is greater than the first time length, therefore, a charging time interval in which the data signal charges the pixel cells when polarity of the data signal is not inverted can be reduced, and further, a time length of charging of the pixel cells by the data signal when polarity of the data signal is not inverted and a time length of charging of the pixel cells by the data signal when polarity of the data signal is inverted are made close to each other or the same, accordingly, luminance of the pixel cells is made more even, which further avoids or makes improvement with respect to undesirable phenomena such as vertical stripes.

BRIEF DESCRIPTION OF THE DRAWINGS

A brief introduction of drawings used in the embodiments will be provided below.

DETAILED DESCRIPTION OF THE EMBODIMENTS

Figure 1:
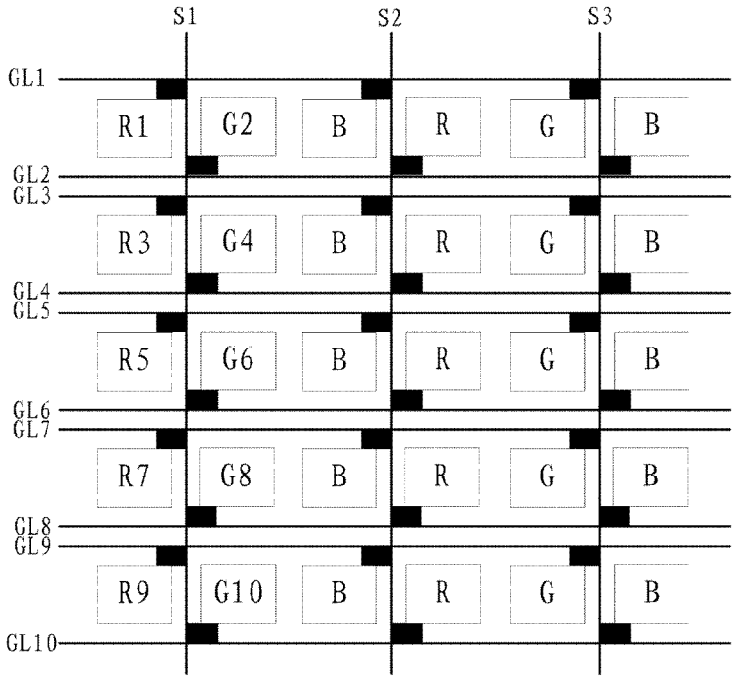
FIG. 1 is a schematic structure diagram of a Dual Gate design of a display panel provided by an embodiment of present disclosure.

Hereinafter, the technical solutions in the embodiments of the present disclosure will be described clearly and comprehensively in combination with the drawings of the embodiments. Obviously, these described embodiments are merely parts of the embodiments of the present disclosure, rather than all of the embodiments thereof, the other embodiments obtained by those of ordinary skill in the art based on the embodiments of the present disclosure without paying creative efforts all fall into the protection scope of the present disclosure.

Transistors adopted in all of the embodiments of the present disclosure may be a thin film transistor, or a Field Effect Transistor, or other devices of the same properties each. Based on a function achieved in the circuit, transistors adopted in the embodiments of the present disclosure mainly are switching transistors. Since the source and the drain of the switching transistors adopted here are symmetrical, the source and the drain of these transistors are interchangeable. In the embodiments of the present disclosure, in order to differentiate the two electrodes other than the gate of the transistors, the source thereof is referred to as a first terminal, the drain thereof is referred to as a second terminal. According to forms in the drawings, it is prescribed that an intermediate terminal of the transistors is a gate, a terminal for inputting a signal is a source, and a terminal for outputting a signal is a drain. In addition, transistors adopted in the embodiments of the present disclosure comprise two types, namely P-type switching transistors and N-type switching transistors, wherein the P-type switching transistor is turned on when a gate thereof is at a low voltage level and turned off when a gate thereof is at a high voltage level, and the N-type switching transistor is turned on when a gate thereof is at a high voltage level and turned off when a gate thereof is at a low voltage level.

FIG. 1 is a schematic structure diagram of a Dual Gate design of a display panel provided by an embodiment of present disclosure. An array substrate thereof includes a plurality of data lines (S1, S2, S3 . . . ), a plurality of gate lines (GL1, GL2, GL3 . . . ), and a plurality of pixel cells defined by the plurality of data lines and the plurality of gate lines, the plurality of pixel cells form an array of pixel cells; each pixel cell is connected to one gate line and one data line through one thin film transistor, said gate line is connected to a gate of the thin film transistor, and said data line is connected to a source of the thin film transistor, wherein pixel cells in odd-numbered columns of each row of pixel cells are connected to the same gate line, pixel cells in even-numbered columns thereof are connected to another adjacent gate line, and pixel cells in a 2n-th column and pixel cells in a (2n−1)-th column are connected to the same data line. The plurality of data lines are used to input a data signal to the pixel cells, the plurality of gate lines are used to input a gate driving signal to the pixel cells.

At the time of driving, in a first scanning period, a high voltage level signal is inputted from a gate line GL1, thin film transistors of pixel cells in odd-numbered columns of the first row are turned on, corresponding data lines receive a data signal to charge the pixel cells in odd-numbered columns of the first row, and store the corresponding data; in a second scanning period, a high voltage level signal is inputted from a gate line GL2, thin film transistors of pixel cells in even-numbered columns of the first row are turned on, corresponding data lines charge the pixel cells in even-numbered columns of the first row, next, a high voltage level signal is inputted from gate lines GL3, GL4 and so on in sequence, which cooperates with the corresponding data lines to charge the corresponding pixel cells. Like the traditional liquid crystal displaying, in order to avoid causing damage to liquid crystal molecules because of using a positive voltage or a negative voltage all the time to drive the liquid crystal molecules, the data lines adopt a way of alternating a positive voltage and a negative voltage to drive liquid crystal molecules, that is, polarity of the data signals outputted to the same data line is inverted for one time every n scan periods. However, when polarity of the data signals is inverted, a source driving circuit requires a rising delay time period to output the data signals, thus, a time interval for writing data into the pixel cells when polarity of signals on the data lines is inverted is shorter than a time interval for writing data into the pixel cells when polarity of signals on the data lines is not inverted, this further results in that pixel cells in some columns are charged more, pixel cells in some other columns are charged less, so uneven luminance of the pixel cells appears, which thereby leads to undesirable phenomena such as vertical stripes.

Hereinafter, invention principles of the present disclosure will be explained taking a display panel with 15.6 Full HD Dual-Gate design as an example, said display panel includes an array of 1920*1080 pixel cells, polarity of data signals on the data lines is inverted for one time every two scanning periods, and polarity inversion of the data signals always occurs in the odd-numbered columns of pixel cells, and in actual measurement, a rising delay time length of a source driving chip when polarity of the data signals is inverted is 780 ns, so an actual charging time interval of the odd-numbered columns of pixel cells is less than an actual charging time interval of the even-numbered columns of pixel cells by 780 ns.

For example, referring to FIG. 1, the display panel includes gate lines GL1, GL2, GL3 . . . , data lines S1, S2, S3 . . . , and pixel cells R1, G2, R3, G4; scanning sequences of the gate lines are GL1, GL2, GL3 . . . GL10 in order, the data line S1 writes data to the pixel cells R1, G2, R3, G4, R5, G6, R7, G8, R9 and G10 sequentially. S1 writes data to R1 in a GL1 scanning stage, S1 writes data to G2 in a GL2 scanning stage. However, since the data signal on S1 is inverted in the GL1 scanning stage, a charging time interval of R1 is less than a charging time interval of G2 by 780 ns, likewise, a charging time interval of R3 is less than a charging time interval of G4 by 780 ns, a charging time interval of R5 is less than a charging time interval of G6 by 780 ns . . . ; as such, a charging time interval of pixel cells in an odd-numbered column is always less than a charging time interval of pixel cells in an even-numbered column by 780 ns, luminance of pixel cells in an odd-numbered column and luminance of pixel cells in an even-numbered column are uneven, pixel cells in an odd-numbered column are darker, pixel cells in an even-numbered column are brighter, which further leads to undesirable phenomena such as vertical stripes.

Figure 2:
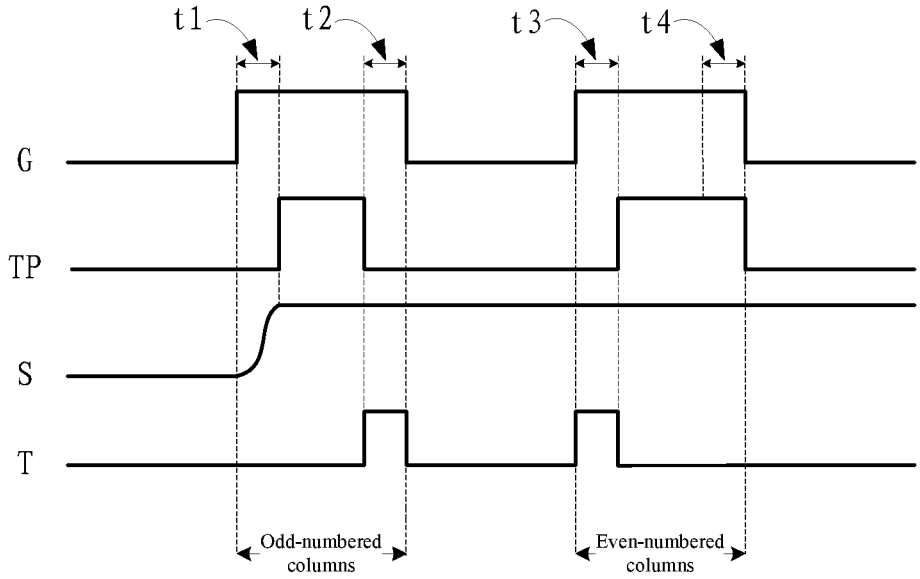
FIG. 2 is a timing state diagram of respective signals in a touch display panel provided by an embodiment of present disclosure.

FIG. 2 is a time state diagram of a gate driving signal G outputted by a gate driving circuit, a data signal S outputted by a source driving circuit, a threshold voltage TP outputted by a threshold voltage driving circuit, and a charging time interval T of pixel cells according to an embodiment of the present disclosure. In FIG. 2, t1 represents a rising delay time length when the data signal is inverted; t2 represents a charging time interval of pixel cells in an odd-numbered column, t3 represents a charging time interval of pixel cells in an even-numbered column, t4 represents a difference between a time length during which an odd-numbered column corresponds to a TP at a high voltage level and a time length during which an even-numbered column corresponds to a TP at a high voltage level; where t1=t4=780 ns. When the gate driving signal is at a high voltage level and the threshold voltage is at a low voltage level, the data signal charges the pixel cells. In the embodiment of the present disclosure, by means of making an output time interval of the threshold voltage at a high voltage level to which pixel cells in an even-numbered column correspond be more than an output time interval of the threshold voltage at a low voltage level to which pixel cells in an odd-numbered column correspond by 780 ns, the charging time interval for pixel cells in an even-numbered column is reduced by 780 ns, and thereby the charging time interval for pixel cells in an odd-numbered column and the charging time interval for pixel cells in an even-numbered column are made equal, i.e., t2=t3. Luminance of pixel cells in an odd-numbered column and luminance of pixel cells in an even-numbered column are uneven, so as to finally avoid or make improvement with respect to undesirable phenomena such as vertical stripes.

Figure 3:
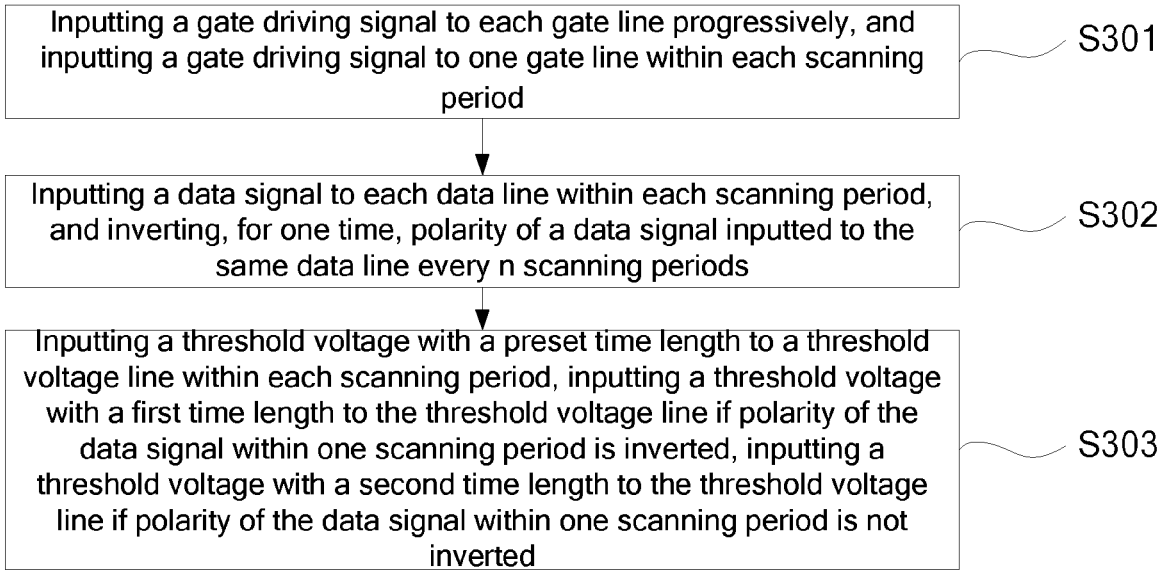
FIG. 3 is a flowchart of steps of a driving method for a display device provided by an embodiment of present disclosure.

FIG. 3 is a flowchart of steps of a driving method for a display device provided by an embodiment of present disclosure. As shown in FIG. 3, the driving method for a display device comprises the following steps.

In S301, a gate driving signal is inputted to each gate line progressively, and a gate driving signal is inputted to one gate line within each scanning period.

That is, the gate driving signal scans pixel cells of the display device progressively, wherein one scanning period is a time length of scanning one row of pixel cells.

In S302, a data signal S is inputted to each data line within each scanning period, and polarity of a data signal S inputted to the same data line is inverted for one time every n scanning periods, n being a positive integer.

That is, the data signal S charges the pixel cells being scanned by the gate driving signal G in the display device.

In S303, a threshold voltage TP with a preset time length is inputted to a threshold voltage line within each scanning period, a threshold voltage TP with a first time length is inputted to the threshold voltage line if polarity of the data signal within one scanning period is inverted, a threshold voltage TP with a second time length is inputted to the threshold voltage line if polarity of the data signal within one scanning period is not inverted, the data signal S inputted to the data line is latched when a threshold voltage TP is inputted to the threshold voltage line, and the data signal S inputted to the data line is outputted when no threshold voltage TP is inputted to the threshold voltage line.

The second time length is greater than the first time length.

In the driving method for a display device as provided by the embodiment of the present disclosure, within each scanning period, a gate driving signal is inputted to one gate line, a data signal is inputted to each data line, and a threshold voltage with a preset time length is inputted to a threshold voltage line, because the data signal inputted to the data line is latched when a threshold voltage is inputted to the threshold voltage line, and the data signal inputted to the data line is outputted when no threshold voltage is inputted to the threshold voltage line, a threshold voltage with a first time length is inputted to the threshold voltage line if polarity of the data signal within one scanning period is inverted, a threshold voltage with a second time length is inputted to the threshold voltage line if polarity of the data signal within one scanning period is not inverted, the second time length is greater than the first time length, therefore, a charging time interval in which the data signal charges the pixel cells when polarity of the data signal is not inverted can be reduced, and further, a time length of charging of the pixel cells by the data signal when polarity of the data signal is not inverted and a time length of charging of the pixel cells by the data signal when polarity of the data signal is inverted are made close to each other or the same. Accordingly, in embodiments of the present disclosure, luminance of the pixel cells is made more even, which further avoids or makes improvement with respect to undesirable phenomena such as vertical stripes.

For example, a difference between the second time length and the first time length in the above embodiment is a rising delay time length when polarity of the data signal is inverted.

If a difference between the second time length and the first time length is a rising delay time length when polarity of the data signal is inverted, then a charging time length of the pixel cells when polarity of the data signal is not inverted and a charging time length of the pixel cells when polarity of the data signal is inverted can be made equal, which thereby can totally avoid undesirable phenomena such as vertical stripes caused by that the pixel cells are not charged evenly.

For example, n is equal to 2. That is, polarity of the data signal inputted to the same data line is inverted for one time every two scanning periods.

Figure 4:
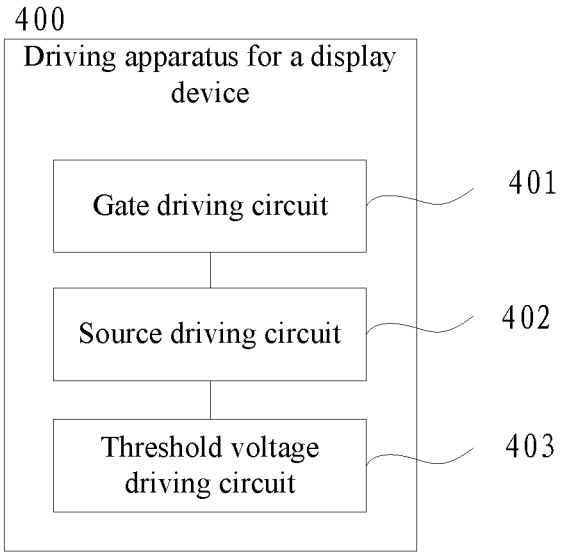
FIG. 4 is a schematic structure diagram of a driving apparatus for a display device provided by an embodiment of present disclosure.

FIG. 4 is a schematic structure diagram of a driving apparatus 400 for a display device provided by an embodiment of present disclosure. Referring to FIG. 4, the driving apparatus 400 for a display device comprises a gate driving circuit 401, a source driving circuit 402 and a threshold voltage driving circuit 403.

The gate driving circuit 401 is connected to each gate line, and configured to input a gate driving signal to each gate line progressively, and input a gate driving signal to one gate line within each scanning period.

No limitations are made to the gate driving circuit in the embodiment of the present disclosure, as long as the gate driving circuit can output a gate driving signal that progressively scans pixel cells in a display device. Exemplarily, the gate driving circuit may be a GOA circuit.

The source driving circuit 402 is connected to each data line, and configured to input a data signal to each data line within each scanning period, and invert, for one time, polarity of a data signal inputted to the same data line every n scanning periods.

Also, no limitations are made to the source driving circuit in the embodiment of the present disclosure, as long as the source driving circuit can output a data signal that charges pixel cells in a display device and polarity of which is inverted every n scanning periods. Exemplarily, the gate driving circuit may be a source chip.

The threshold voltage driving circuit 403 is connected to a threshold voltage line, and configured to input a threshold voltage with a preset time length to the threshold voltage line within each scanning period, input a threshold voltage with a first time length to the threshold voltage line if polarity of the data signal within one scanning period is inverted, input a threshold voltage with a second time length to the threshold voltage line if polarity of the data signal within one scanning period is not inverted; the data signal inputted to the data line by the source driving circuit is latched when a threshold voltage is inputted to the threshold voltage line by the threshold voltage driving circuit, and the data signal inputted to the data line by the source driving circuit is outputted when no threshold voltage is inputted to the threshold voltage line by the threshold voltage driving circuit.

The second time length is greater than the first time length, and n is a positive integer.

The driving apparatus for a display device provided by an embodiment of the present disclosure comprises a gate driving circuit, a source driving circuit and a threshold voltage driving circuit; within each scanning period, a gate driving signal is inputted to one gate line by the gate driving circuit, a data signal is inputted to each data line by the source driving circuit, and a threshold voltage with a preset time length is inputted to a threshold voltage line by the threshold voltage driving circuit, as the data signal inputted to the data line is latched when a threshold voltage is inputted to the threshold voltage line, and the data signal inputted to the data line is outputted when no threshold voltage is inputted to the threshold voltage line, a threshold voltage with a first time length is inputted to the threshold voltage line if polarity of the data signal within one scanning period is inverted, a threshold voltage with a second time length is inputted to the threshold voltage line if polarity of the data signal within one scanning period is not inverted, the second time length is greater than the first time length, therefore, a charging time interval in which the data signal charges the pixel cells when polarity of the data signal is not inverted can be reduced, and further, a time length of charging of the pixel cells by the data signal when polarity of the data signal is not inverted and a time length of charging of the pixel cells by the data signal when polarity of the data signal is inverted are made close to each other or the same. Accordingly, in embodiments of the present disclosure, luminance of the pixel cells is made more even, which further avoids or makes improvement with respect to undesirable phenomena such as vertical stripes.

Figure 5:
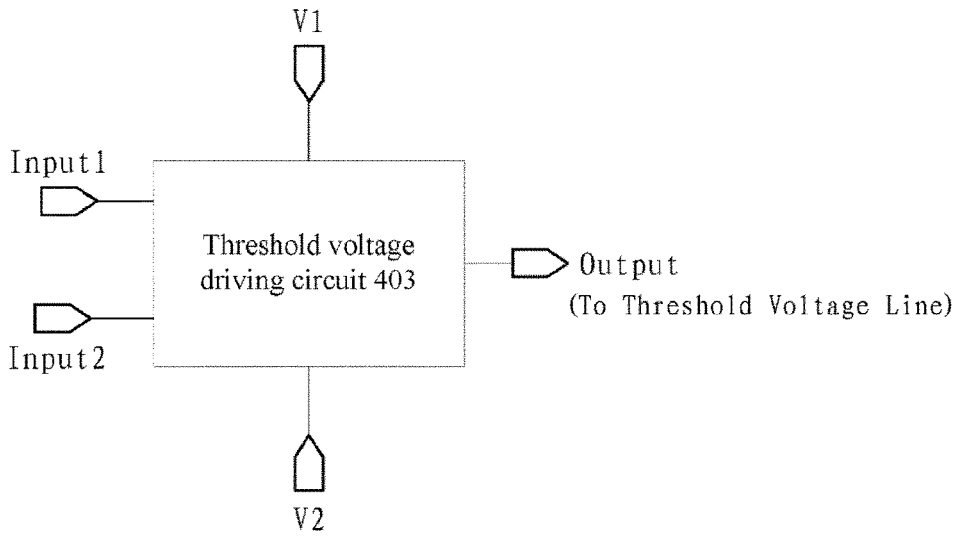
FIG. 5 is a schematic structure diagram of a threshold voltage driving circuit provided by an embodiment of present disclosure.

FIG. 5 is a schematic structure diagram of the threshold voltage driving circuit provided by an embodiment of present disclosure. Referring to FIG. 5, the threshold voltage driving circuit 403 is connected to a first input terminal Input1, a second input terminal Input2, a first voltage level terminal V1, a second voltage level terminal V2 and an output terminal Output, and configured to output a voltage of the first voltage level terminal V1 to the output terminal Output when one of a voltage of the first input terminal Input1 and a voltage of the second input terminal Input2 is at a low voltage level, and the other of the two is at a high voltage level, and output a voltage of the second voltage level terminal V2 to the output terminal Output when the voltage of the first input terminal Input1 and the voltage of the second input terminal Input2 both are at high voltage levels or both are at low voltage levels.

Operation process of the above embodiment will be described taking an input signal of the first input terminal Input1 being A, an input signal of the second input terminal Input2 being B, and an output signal at the threshold voltage driving circuit being L as example. The output signal L at the threshold voltage driving circuit is input to the threshold voltage line as the threshold voltage TP. A=1 when a high voltage level is inputted at Input1, B=1 when a high voltage level is inputted at Input2, A=0 when a low voltage level is inputted at Input1, B=0 when a low voltage level is inputted at Input2. A result obtained after performing an exclusive OR operation on the input signal A at the first input terminal Input1 and the input signal B at the second input terminal Input2 is regarded as an output signal L of the threshold voltage driving circuit, its expression is $L=A\overline{B}+\overline{A}B=A\oplus B$. A truth table of logic operation among the input signal A at the first input terminal Input1, the input signal B at the second input terminal Input2, and the output signal L at the output terminal is shown below:

| Input | | Output |
|---|---|---|
| A | B | L |
| 0 | 0 | 0 |
| 0 | 1 | 1 |
| 1 | 0 | 1 |
| 1 | 1 | 0 |

Figure 6:
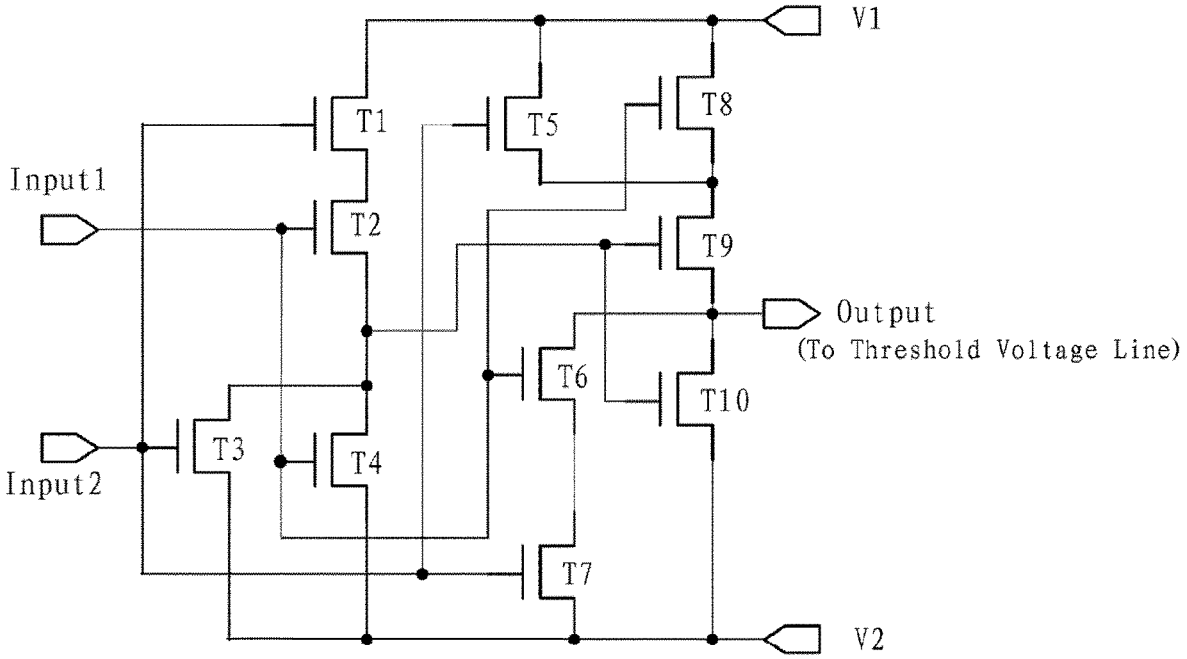
FIG. 6 is a circuit diagram of a threshold voltage driving circuit provided by an embodiment of present disclosure.

FIG. 6 is a circuit diagram of a threshold voltage driving circuit provided by an embodiment of present disclosure. The threshold voltage driving circuit can perform the above exclusive OR operation. Referring to FIG. 6, said circuit comprises a first transistor T1, a second transistor T2, a third transistor T3, a fourth transistor T4, a fifth transistor T5, a sixth transistor T6, a seventh transistor T7, an eighth transistor T8, a ninth transistor T9 and a ten transistor T10.

A first terminal of the first transistor T1 is connected to the first voltage level terminal V1, a second terminal thereof is connected to a first terminal of the second transistor T2, and a gate thereof is connected to the second input terminal Input2.

A second terminal of the second transistor T2 is connected to a first terminal of the third transistor T3, and a gate thereof is connected to the first input terminal Input1.

A first terminal of the third transistor T3 is connected to a first terminal of the fourth transistor T4, a second terminal thereof is connected to the second voltage level terminal V2, and a gate thereof is connected to the second input terminal Input2.

The first terminal of the fourth transistor T4 is connected to a gate of the ninth transistor 9, a second terminal thereof is connected to the second voltage level terminal V2, and a gate thereof is connected to the first input terminal Input1.

A first terminal of the fifth transistor T5 is connected to the first voltage level terminal V1, a second terminal thereof is connected to a second terminal of the eighth transistor T8, a gate thereof is connected to the second input terminal Input2.

A first terminal of the sixth transistor T6 is connected to the output terminal Output, a second terminal thereof is connected to a first terminal of the seventh transistor T7, and a gate thereof is connected to the first input terminal Input1.

A second terminal of the seventh transistor T7 is connected to the second voltage level terminal V2, and a gate thereof is connected to the second input terminal Input2.

A first terminal of the eighth transistor T8 is connected to the first voltage level terminal V1, the second terminal thereof is connected to a first terminal of the ninth transistor T9, and a gate thereof is connected to the first input terminal Input1.

A second terminal of the ninth transistor T9 is connected to the output terminal Output, and the gate thereof is connected to a gate of the tenth transistor T10.

A first terminal of the tenth transistor T10 is connected to the output terminal Output, and a second terminal thereof is connected to the second voltage level terminal V2.

The first transistor T1, the second transistor T2, the fifth transistor T5, the eighth transistor T8 and the ninth transistor T9 are P-type transistors; the third transistor T3, the fourth transistor T4, the sixth transistor T6, the seventh transistor T7 and the ten transistor T10 are N-type transistors.

Operation principles of the above threshold voltage driving circuit will be explained in four cases, wherein the first voltage level terminal V1 provides a high voltage level, the second voltage level terminal V2 provides a low voltage level. Illustratively, the second voltage level terminal V2 may be grounded.

In a first case, a high voltage level is inputted at Input1, a high voltage level is inputted at Input2, that is, the input signal A of the first signal input terminal is A=1, the input signal B of the second input terminal is B=1.

Since Input1 and Input2 both are inputted with a high voltage level, the N-type transistor with a gate directly connected to Input1 or Input2 is turned on, the P-type transistor is turned off. Thus transistors T3, T4, T6 and T7 are turned on, transistors T1, T2, T5 and T8 are turned off; gates of T9 and T10 are connected between the second terminal of T2 and the first terminal of T4, and gates of T9 and T10 are both connected to V2 of a low voltage level through T4, accordingly, T9 is turned on, T10 is turned off. T9 has no signal input, thus Output is at a low voltage level, that is, when A=1 and B=1, the output signal L of Output is L=0.

In a second case, a high voltage level is inputted at Input1, a low voltage level is inputted at Input2, that is, the input signal A of the first signal input terminal is A=1, the input signal B of the second signal input terminal is B=0.

Since a high voltage level is inputted at Input1 and a low voltage level is inputted at Input2, transistors T1, T4, T5 and T6 are turned on, transistors T2, T3, T7 and T8 are turned off, gates of T9 and T10 are both are connected to V2 of a low voltage level through T4, accordingly, T9 is turned on, T10 is turned off. V1 is connected to Output through T5 and T9, thus Output is at a high voltage level, that is, when A=1 and B=0, the output signal of Output is L=1.

In a third case, a low voltage level is inputted at Input1, a high voltage level is inputted at Input2, that is, the input signal A of the first signal input terminal is A=0, the input signal B of the second signal input terminal is B=1.

Since a low voltage level is inputted at Input1 and a high voltage level is inputted at Input2, transistors T2, T3, T7 and T8 are turned on, transistors T1, T4, T5 and T6 are turned off, gates of T9 and T10 are connected to V2 of a low voltage level through T3, thus T9 is turned on, T10 is turned off, V1 is connected to Output through T8 and T9. Thus Output is at a high voltage level, that is, when A=0 and B=1, the output signal L of Output is L=1.

In a fourth case, a low voltage level is inputted at Input1, a low voltage level is inputted at Input2, that is, the input signal A of the first signal input terminal is A=0, the input signal B of the second signal input terminal is B=0.

Since a low voltage level is inputted at Input1 and a low voltage level is inputted at Input2, transistors T1, T2, T5 and T8 are turned on, transistors T3, T4, T6 and T7 are turned off, gates of T9 and T10 are connected to V1 of a high voltage level through T1 and T2, thus T9 is tuned off, T10 is turned on. V2 is connected to Output through T10, thus Output is at a low voltage level, that is, when A=0 and B=0, the output signal of Output is L=0.

Further, the transistor type adopted by respective transistors in the above threshold voltage driving circuit may also be reversed, i.e., an N-type transistor changes into a P-type transistor, a P-type transistor changes into an N-type transistor, which of course is a proper modified solution that can be achieved by those skilled in the art according to the embodiments of the present disclosure, thus all falls into the protection scope of the present disclosure.

Figure 7:
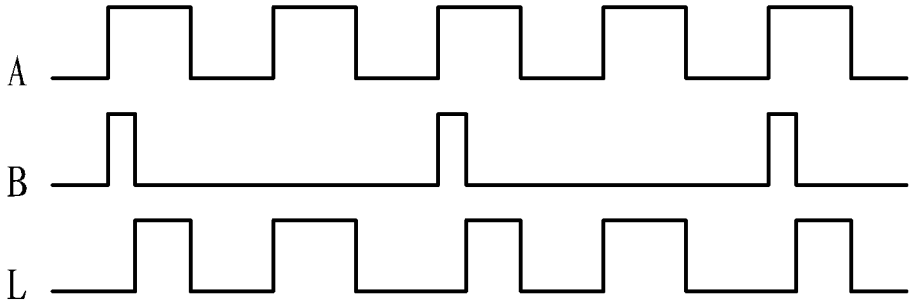
FIG. 7 is a timing state diagram of input and output signals of a threshold voltage driving circuit provided by an embodiment of present disclosure.

For example, n is equal to 2. That is, polarity of the data signal inputted to the same data line is inverted for one time every two scanning periods. FIG. 7 is a timing state diagram of the input signal A at the first input terminal Input1, the input signal B at the second input terminal Input2, and the output signal L at the output terminal Output when n is equal to 2. Referring to FIG. 7, L is at a low voltage level when both A and B are at high voltage levels or both A and B are at low voltage levels, and L is at a high voltage level when one of A and B is at a high voltage level and the other of the two is at a low voltage level. In addition, a rising edge of a voltage pulse inputted by the second input terminal is aligned with a rising edge of a voltage pulse inputted by the first input terminal, and a frequency of the voltage pulse inputted by the first input terminal is twice that of the voltage pulse inputted by the second input terminal.

For example, a length of a voltage pulse inputted by the second input terminal is a rising delay time length when polarity of the data signal is inverted.

If a length of a voltage pulse inputted by the second input terminal is a rising delay time length when polarity of the data signal is inverted, then a charging time length of the pixel cells when polarity of the data signal is not inverted and a charging time length of the pixel cells when polarity of the data signal is inverted can be made equal, which thereby can totally avoid undesirable phenomena such as vertical stripes caused by that pixel cells are not charged evenly.

An embodiment of the present disclosure provides a display device comprising any of the driving apparatus for a display device as described above. In addition, the display device may be any products or any components having a display function, such as electronic paper, mobile phones, tablet computers, televisions, displays, notebook computers, digital picture frames, navigator and the like.

The above described merely are specific implementations of the present disclosure, but the protection scope of the present disclosure is not limited thereto, modification and replacements easily conceivable for those skilled in the art within the technical range revealed by the present disclosure all fall into the protection scope of the present disclosure. Therefore, the protection scope of the present disclosure is based on the protection scope of the claims.

What is claimed is:

1. A driving apparatus for driving a display device, said driving apparatus comprising a gate driving circuit, a source driving circuit and a threshold voltage driving circuit, the gate driving circuit being connected to each gate line of a plurality of gate lines, and configured to input a gate driving signal to said each gate line stage by stage, the gate driving signal being input to one of the plurality of gate lines within each scanning period;

the source driving circuit being connected to each data line of a plurality of data lines, and configured to input a data signal to said each data line within said each scanning period, polarity of the data signal inputted to a same data line being inverted every n scanning periods, n is a positive integer; and the threshold voltage driving circuit being connected to a threshold voltage line, and configured to input a threshold voltage to the threshold voltage line within said each scanning period, wherein the threshold voltage driving circuit is configured to input a threshold voltage having a first time length to the threshold voltage line in the case that polarity of the data signal is inverted within a scanning period, and is configured to input a threshold voltage having a second time length to the threshold voltage line in the case that polarity of the data signal is not inverted within a scanning period, the second time length is greater than the first time length.

2. The driving apparatus according to claim 1, wherein the threshold voltage driving circuit is connected to a first input terminal, a second input terminal, a first voltage level terminal, a second voltage level terminal and an output terminal, and configured to output a voltage of the first voltage level terminal to the output terminal when one of a voltage of the first input terminal and a voltage of the second input terminal is at a low voltage level, and the other of the two is at a high voltage level; and output a voltage of the second voltage level terminal to the output terminal when the voltage of the first input terminal and the voltage of the second input terminal both are at high voltage levels or both are at low voltage levels.

3. The driving apparatus according to claim 2, wherein the threshold voltage driving circuit comprises:

a first transistor, a first terminal thereof being connected to the first voltage level terminal, and a gate thereof being connected to the second input terminal;

a second transistor, a first terminal thereof being connected to a second terminal of the first transistor, and a gate thereof being connected to the first input terminal;

a third transistor, a first terminal thereof being connected to a second terminal of the second transistor, a second terminal thereof being connected to the second voltage level terminal, and a gate thereof being connected to the second input terminal;

a fourth transistor, a first terminal thereof being connected to the first terminal of the third transistor, a second terminal thereof being connected to the second voltage level terminal, and a gate thereof being connected to the first input terminal;

a fifth transistor, a first terminal thereof being connected to the first voltage level, and a gate thereof being connected to the second input terminal;

a sixth transistor, a first terminal thereof being connected to the output terminal, and a gate thereof being connected to the first input terminal;

a seventh transistor, a first terminal thereof being connected to a second terminal of the sixth transistor, a second terminal thereof being connected to the second voltage level terminal, and a gate thereof being connected to the second input terminal;

an eighth transistor, a first terminal thereof being connected to the first voltage level terminal, a second terminal thereof being connected to a second terminal of the fifth transistor, and a gate thereof being connected to the first input terminal;

a ninth transistor, a first terminal thereof being connected to the second terminal of the eighth transistor, a second terminal thereof being connected to the output terminal, and a gate thereof being connected to the first terminal of the fourth transistor;

a tenth transistor, a first terminal thereof being connected to the output terminal, a second terminal thereof being connected to the second voltage level terminal, and a gate thereof being connected to the gate of the ninth transistor;

the first transistor, the second transistor, the fifth transistor, the eighth transistor and the ninth transistor being P-type transistors; the third transistor, the fourth transistor, the sixth transistor, the seventh transistor and the tenth transistor being N-type transistors.

4. The driving apparatus according to claim 2, wherein n is equal to 2.

5. The driving apparatus according to claim 4, wherein a rising edge of a voltage pulse inputted by the second input terminal is aligned with a rising edge of a voltage pulse inputted by the first input terminal, and a frequency of the voltage pulse inputted by the first input terminal is twice that of the voltage pulse inputted by the second input terminal.

6. The driving apparatus according to claim 5, wherein a length of the voltage pulse inputted by the second input terminal is a rising delay time length when polarity of the data signal is inverted.

7. The driving apparatus according to claim 1, wherein, the source driving circuit is configured to output the data signal inputted to the data line to a pixel unit in the case that no threshold voltage is inputted to the threshold voltage line by the threshold voltage driving circuit in said each scanning period.

8. A display device comprising the driving apparatus according to claim 1.

9. The display device according to claim 8, wherein the threshold voltage driving circuit is connected to a first input terminal, a second input terminal, a first voltage level terminal, a second voltage level terminal and an output terminal, and configured to output a voltage of the first voltage level terminal to the output terminal when one of a voltage of the first input terminal and a voltage of the second input terminal is at a low voltage level, and the other of the two is at a high voltage level; and output a voltage of the second voltage level terminal to the output terminal when the voltage of the first input terminal and the voltage of the second input terminal both are at high voltage levels or both are at low voltage levels.

10. The display device according to claim 9, wherein the threshold voltage driving circuit comprises:

a first transistor, a first terminal thereof being connected to the first voltage level terminal, and a gate thereof being connected to the second input terminal;

a second transistor, a first terminal thereof being connected to a second terminal of the first transistor, and a gate thereof being connected to the first input terminal;

a third transistor, a first terminal thereof being connected to a second terminal of the second transistor, a second terminal thereof being connected to the second voltage level terminal, and a gate thereof being connected to the second input terminal;

a fourth transistor, a first terminal thereof being connected to the first terminal of the third transistor, a second terminal thereof being connected to the second voltage level terminal, and a gate thereof being connected to the first input terminal;

a fifth transistor, a first terminal thereof being connected to the first voltage level, and a gate thereof being connected to the second input terminal;

a sixth transistor, a first terminal thereof being connected to the output terminal, and a gate thereof being connected to the first input terminal;

a seventh transistor, a first terminal thereof being connected to a second terminal of the sixth transistor, a second terminal thereof being connected to the second voltage level terminal, and a gate thereof being connected to the second input terminal;

an eighth transistor, a first terminal thereof being connected to the first voltage level terminal, a second terminal thereof being connected to a second terminal of the fifth transistor, and a gate thereof being connected to the first input terminal;

a ninth transistor, a first terminal thereof being connected to the second terminal of the eighth transistor, a second terminal thereof being connected to the output terminal, and a gate thereof being connected to the first terminal of the fourth transistor;

a tenth transistor, a first terminal thereof being connected to the output terminal, a second terminal thereof being connected to the second voltage level terminal, and a gate thereof being connected to the gate of the ninth transistor;

the first transistor, the second transistor, the fifth transistor, the eighth transistor and the ninth transistor being P-type transistors; the third transistor, the fourth transistor, the sixth transistor, the seventh transistor and the tenth transistor being N-type transistors.

11. The display device according to claim 8, wherein n is equal to 2.

12. The display device according to claim 11, wherein a rising edge of the voltage pulse inputted by the second input terminal is aligned with a rising edge of a voltage pulse inputted by the first input terminal, and a frequency of the voltage pulse inputted by the first input terminal is twice that of the voltage pulse inputted by the second input terminal.

13. The display device according to claim 12, wherein a length of a voltage pulse inputted by the second input terminal is a rising delay time length when polarity of the data signal is inverted.

14. The display device according to claim 8, wherein, the source driving circuit is configured to output the data signal inputted to the data line to a pixel unit in the case that no threshold voltage is inputted to the threshold voltage line by the threshold voltage driving circuit in said each scanning period.

15. A driving method performed by a driving apparatus for driving a display device, said driving apparatus comprising a gate driving circuit being connected to each gate line of a plurality of gate lines, a source driving circuit being connected to each data line of a plurality of data lines, and a threshold voltage driving circuit being connected to a threshold voltage line, the threshold voltage driving circuit is connected to a first input terminal, a second input terminal, a first voltage level terminal, a second voltage level terminal and an output terminal, the driving method comprising the steps:

(a) inputting, by the gate driving circuit, a gate driving signal to said each gate line stage by stage, the gate driving signal being input to one of the plurality of gate lines within each scanning period;

(b) inputting, by the source driving circuit, a data signal to said each data line within said each scanning period, polarity of the data signal inputted to a same data line being inverted every n scanning periods, n is a positive integer; and (c) inputting, by the threshold voltage driving circuit, a threshold voltage to the threshold voltage line within said each scanning period, wherein the step (c) further comprising:

inputting a threshold voltage having a first time length to the threshold voltage line in the case that polarity of the data signal is inverted within a scanning period, and inputting a threshold voltage having a second time length to the threshold voltage line in the case that polarity of the data signal is not inverted within a scanning period, the second time length is greater than the first time length.

16. The driving method according to claim 15, wherein the driving method further comprising the step (d):

outputting, by the threshold voltage driving circuit, a voltage of the first voltage level terminal to the output terminal when one of a voltage of the first input terminal and a voltage of the second input terminal is at a low voltage level, and the other of the two is at a high voltage level; and outputting, by the threshold voltage driving circuit, a voltage of the second voltage level terminal to the output terminal when the voltage of the first input terminal and the voltage of the second input terminal both are at high voltage levels or both are at low voltage levels.

17. The driving method according to claim 16, wherein n is equal to 2.

18. The driving method according to claim 17, wherein a rising edge of the voltage pulse inputted by the second input terminal is aligned with a rising edge of a voltage pulse inputted by the first input terminal, and a frequency of the voltage pulse inputted by the first input terminal is twice that of the voltage pulse inputted by the second input terminal.

19. The driving method according to claim 18, wherein a length of a voltage pulse inputted by the second input terminal is a rising delay time length when polarity of the data signal is inverted.

20. The driving method according to claim 15, wherein the step (c) further comprising: in said each scanning period, when no threshold voltage is inputted to the threshold voltage line by the threshold voltage driving circuit, outputting the data signal inputted to the data line by the source driving circuit to a pixel unit.

* * * * *